US010729216B2

(12) United States Patent
Schafer et al.

(10) Patent No.: US 10,729,216 B2
(45) Date of Patent: Aug. 4, 2020

(54) RING STORAGE CONTAINER

(71) Applicant: Kimberly Ann Schafer, San Diego, CA (US)

(72) Inventors: Kimberly Ann Schafer, San Diego, CA (US); TsinLam Raymond Cheng, San Diego, CA (US)

(73) Assignee: Kimberly Ann Schafer, San Diego, CA (US)

( * ) Notice: Subject to any disclaimer, the term of this patent is extended or adjusted under 35 U.S.C. 154(b) by 151 days.

(21) Appl. No.: 15/873,691

(22) Filed: Jan. 17, 2018

(65) Prior Publication Data

US 2018/0199685 A1 Jul. 19, 2018

Related U.S. Application Data

(60) Provisional application No. 62/499,180, filed on Jan. 17, 2017.

(51) Int. Cl.

| | |
|---|---|
| ***A45C 11/04*** | (2006.01) |
| ***A45C 11/16*** | (2006.01) |
| ***B65D 85/02*** | (2006.01) |
| ***A44C 9/00*** | (2006.01) |
| *A45C 11/00* | (2006.01) |

(52) U.S. Cl.

CPC ..... *A45C 11/16* (2013.01); *A44C 9/0092* (2013.01); *B65D 85/02* (2013.01); *A45C 2011/007* (2013.01)

(58) Field of Classification Search

CPC ... A45C 11/16; A45C 2011/007; B65D 85/02; A44C 9/0092

USPC ..... 206/6.1, 303, 493, 566

See application file for complete search history.

(56) References Cited

U.S. PATENT DOCUMENTS

| | | | | | |
|---|---|---|---|---|---|
| 2,963,149 | A * | 12/1960 | Bergh | A45C 11/16 | 206/565 |
| 2,978,110 | A | 4/1961 | Haskins | | |
| 4,341,300 | A * | 7/1982 | Roy | B43M 99/002 | 206/523 |
| 5,035,319 | A * | 7/1991 | Kunisch | A45C 11/16 | 206/566 |
| 5,547,072 | A * | 8/1996 | Kaiser | A45C 11/16 | 206/6.1 |

(Continued)

FOREIGN PATENT DOCUMENTS

| | | |
|---|---|---|
| CN | 204105129 U | 1/2015 |
| DE | 9406943 U1 | 7/1994 |

(Continued)

*Primary Examiner* — Luan K Bui

(74) *Attorney, Agent, or Firm* — Mintz, Levin, Cohn, Ferris, Glovsky and Popeo, P.C.

(57) ABSTRACT

A storage container for securely holding one or more rings is provided. The storage container includes a base with a base coupling feature that can be coupled to a lid coupling feature of a lid. Both the base and the lid have sidewalls that define respective inner regions. A post extends from a bottom portion of the base and is contained within the base inner region and the lid inner region when the base and lid are coupled together. The storage container consistent with implementations of the current subject matter provides for easy storage of rings on the post and other items that may be loosely held within the inner regions.

15 Claims, 11 Drawing Sheets

(56) References Cited

U.S. PATENT DOCUMENTS

| | | | | | |
|---|---|---|---|---|---|
| 5,588,525 | A * | 12/1996 | Rosler | B65D 85/02 | 206/303 |
| 5,649,625 | A * | 7/1997 | Ovadia | A47F 7/02 | 206/493 |
| 8,307,982 | B1 * | 11/2012 | Vovan | B65D 1/22 | 206/467 |
| 8,522,964 | B1 | 9/2013 | Pledger | | |
| 2004/0154935 | A1 * | 8/2004 | Kaminski | A45C 11/16 | 206/6.1 |
| 2009/0107856 | A1 * | 4/2009 | Egnatic | A47L 15/505 | 206/6.1 |
| 2015/0122820 | A1 * | 5/2015 | Whitley | A45C 11/16 | 220/528 |

FOREIGN PATENT DOCUMENTS

| | | | |
|---|---|---|---|
| JP | H0523208 | A | 2/1993 |
| KR | 20160123735 | A | 10/2016 |

* cited by examiner

RING STORAGE CONTAINER

CROSS-REFERENCE TO RELATED APPLICATIONS

This applications claims priority to U.S. Provisional Patent Application No. 62/499,180, filed on Jan. 17, 2017 and entitled "Personal Ring Holder with Hook Attachment," the disclosure of which is incorporated herein by reference in its entirety.

BACKGROUND

There are often times and circumstances when it is desirable to safely and conveniently store one or more rings or other small personal items (e.g., earrings, charms, etc.) of an individual. It may also be desirable to securely maintain the rings or other small personal items being stored with an individual.

SUMMARY

Aspects of the current subject matter relate to a storage container for securely holding one or more personal rings, such as earrings or finger rings, and/or other small personal items.

According to an implementation of the current subject matter, a storage container includes: a base comprising an inner base region defined by a base sidewall extending from a base plate, the base sidewall including a base coupling feature, the base further comprising a post extending vertically upward from the inner base region for holding one or more rings thereon; and a lid comprising an inner lid region defined by a lid sidewall extending from a lid top, the lid sidewall including a lid coupling feature that releasably couples to the base coupling feature to thereby releasably couple the lid to the base. The post is contained within the inner base region and the inner lid region when the lid and the base are coupled together.

According to another implementation of the current subject matter, a storage container includes: a base comprising an inner base region defined by a base sidewall extending from a base plate, the base sidewall forming a first circular perimeter having a first diameter and a second circular perimeter having a second diameter less than that of the first diameter, wherein the first circular perimeter and the second circular perimeter are joined by a shelf region, wherein the base sidewall includes a threaded base coupling feature on the second circular perimeter, and the base further comprising a post extending vertically upward from the inner base region for holding one or more rings thereon; and a lid comprising an inner lid region defined by a lid sidewall extending from a lid top, the lid sidewall forming a third circular perimeter having a third diameter equal to that of the first diameter, and the lid sidewall including a threaded lid coupling feature that releasably couples to the threaded base coupling feature to thereby releasably couple the lid to the base by an interlocking action. The post is contained within the inner base region and the inner lid region when the lid and the base are coupled together. A lid bottom of the lid rests on the shelf region of the base sidewall when the lid and the base are coupled together, aligning the first circular perimeter and the third circular perimeter.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

DETAILED DESCRIPTION

Implementations of the current subject matter are directed to a storage container for holding one or more personal rings, such as earrings, finger rings, and the like, and/or other small personal items. Often times, individuals may find it necessary or convenient to have a container in which one or more finger rings (also herein referred to simply as "rings") or other items may be safely stored. A storage container for holding one or more rings and/or other small personal items, in accordance with implementations of the current subject matter, is portable, secure, and easy to use. The storage container may be a stand-alone container or, according to some aspects of the current subject matter, may include a fastener for attaching the storage container to a key chain, purse, table, or other personal storage item.

Figure 1A:
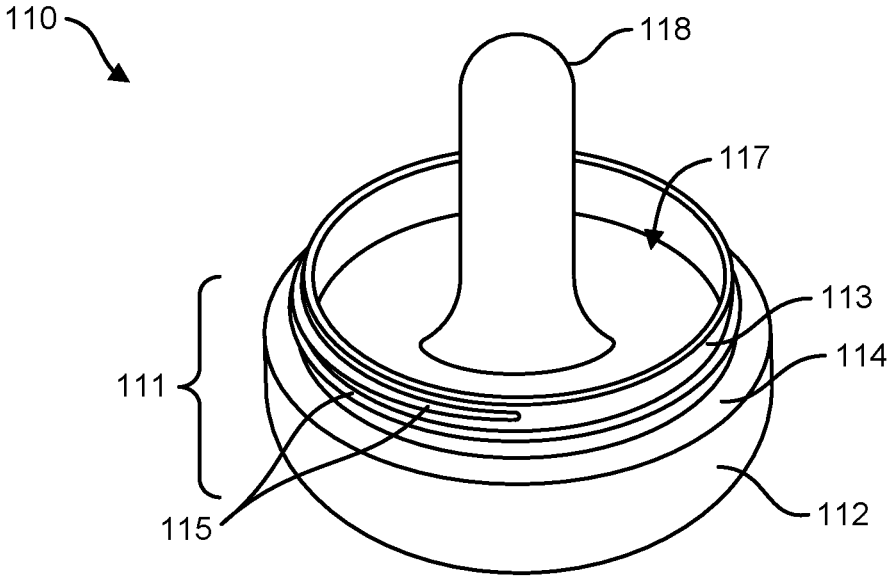
FIGS. 1A and 1B illustrate, via a top perspective view and a side view, respectively, features of a base of a storage container consistent with implementations of the current subject matter.
Figure 1B:
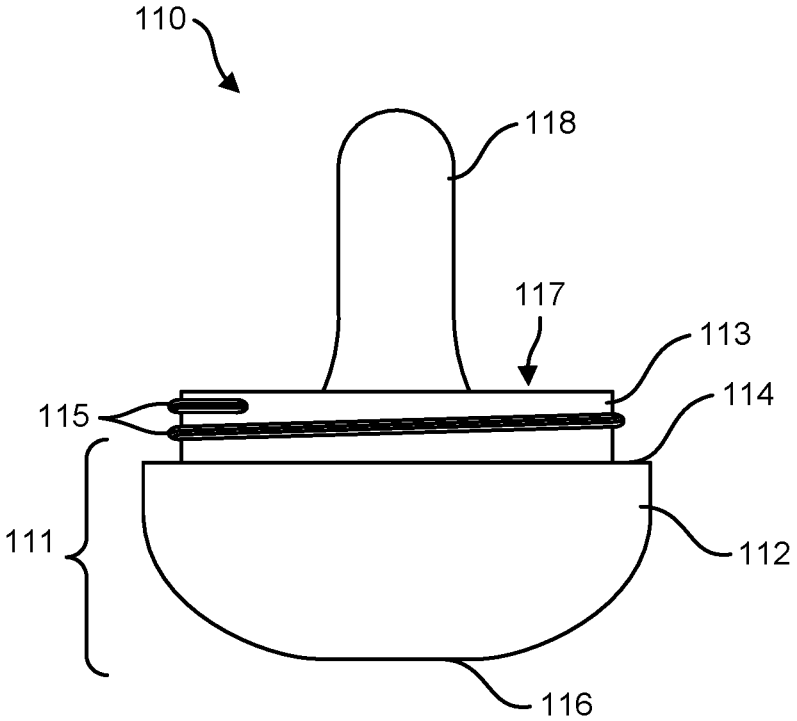

FIGS. 1A and 1B illustrate, via a top perspective view and a side view, respectively, features of a base 110 of a storage container (e.g., storage container 100 shown in FIGS. 3A, 3B, and 4) consistent with implementations of the current subject matter. As shown, the base 110 may be of a generally round shape, although the base is not limited to a round shape and other shapes (such as cubes, for example) may be utilized.

The base 110 has a base sidewall 111 extending from a base plate 116. The base plate 116, or base bottom, may be flat to allow the base 110 to rest on a flat surface. The base sidewall 111, in the implementation shown in FIGS. 1A and 1B, may have two base sidewall portions: bottom portion 112 forming a first circular perimeter having a first diameter and upper portion 113 forming a second circular perimeter having a second diameter less than that of the first diameter. As shown the two portions 112 and 113 are joined by a flat shelf region 114.

The base 110 has an inner base region 117 defined by the base sidewall 111. The base 110 further includes a post 118 extending vertically upward from the inner base region 117 for holding one or more rings thereon. According to some aspects of the present subject matter, the inner base region 117 may be partially filled so that the post 118 extends from a top surface of the filled region. For example, the bottom portion 112 may be a solid material from which the post 118 extends. As shown, the post 118 may be tapered, with a base portion larger than that of the top. The tapered region may have a sharper taper (i.e., taper from a narrow top portion to a larger bottom portion more drastically) than that shown. According to some embodiments, the post 118 is not tapered and instead has a constant diameter from top to bottom. The post 118 may have a round cross-section, and additionally the top portion of the post 118 may be curved or rounded. This design allows for one or more rings to slide down the post 118 without causing any damage to the rings. Other configurations are also possible.

The base sidewall 111 includes a base coupling feature 115, which in FIGS. 1A and 1B is shown to be one or more threaded portions 115 extending around at least a portion of the second circular perimeter of the upper portion 113 of the base sidewall 111.

Figure 2A:
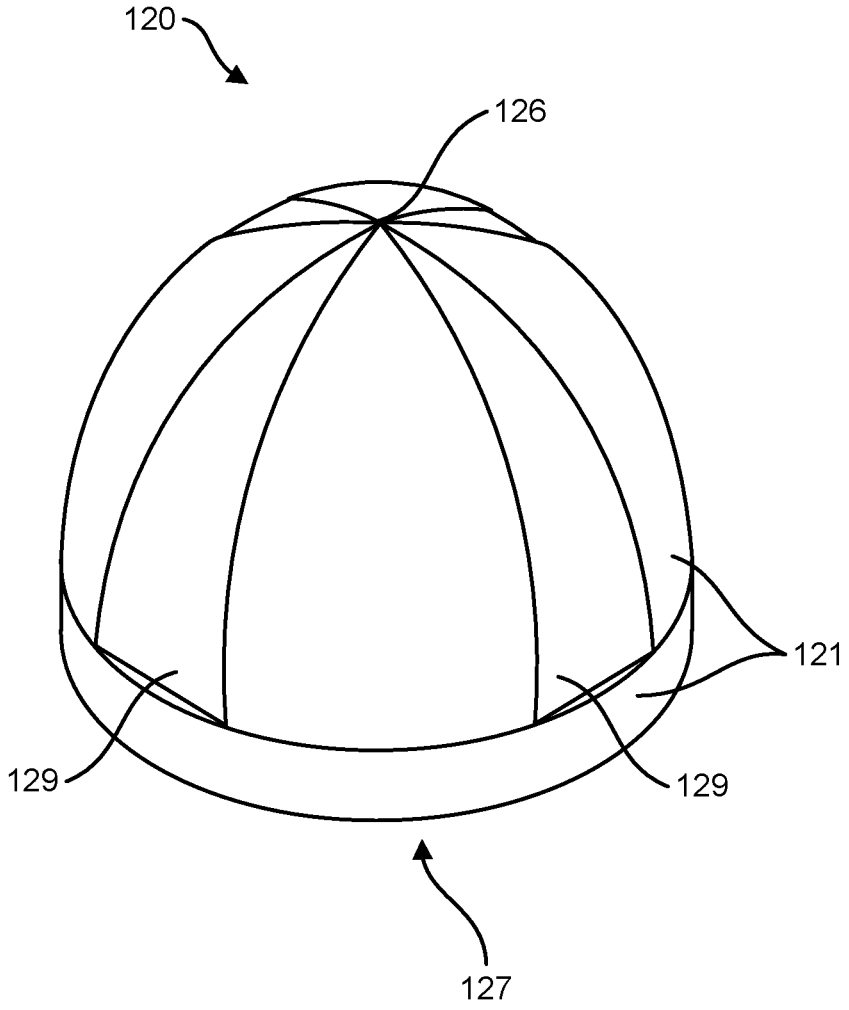
FIGS. 2A, 2B, and 2C illustrate, via a top perspective view, a bottom perspective view, and a bottom view, respectively, features of a lid of a storage container consistent with implementations of the current subject matter.
Figure 2B:
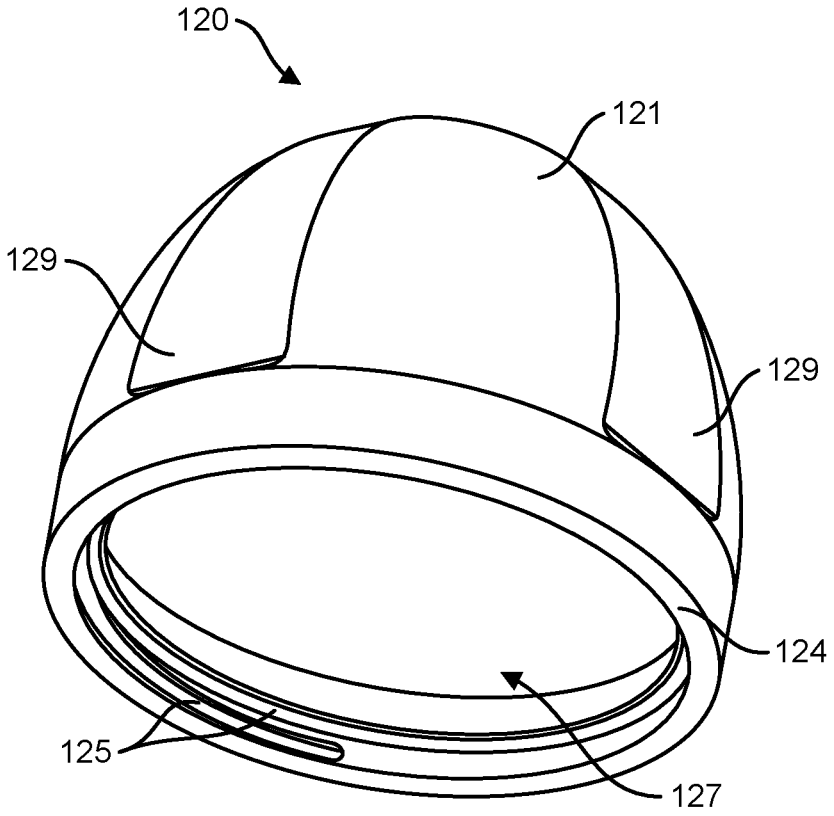
Figure 2C:
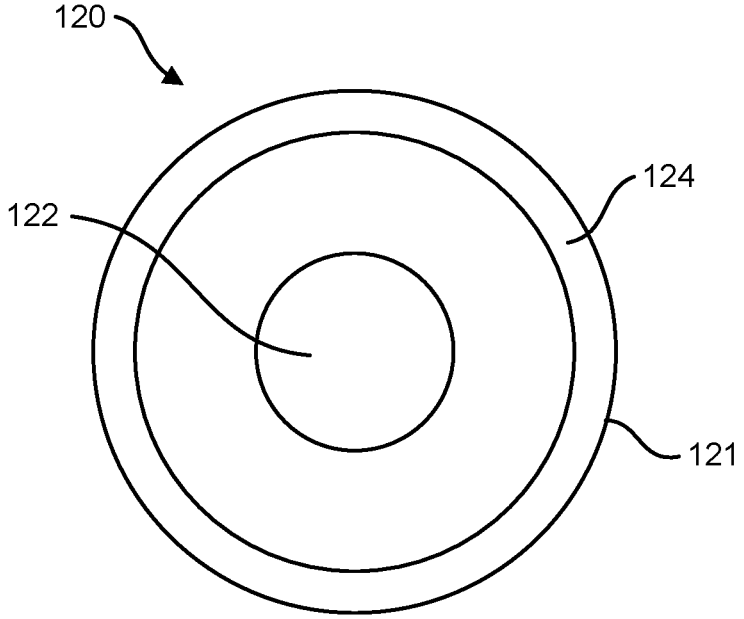

FIGS. 2A, 2B, and 2C illustrate, via a top perspective view, a bottom perspective view, and a bottom view, respectively, features of a lid 120 of a storage container 100 consistent with implementations of the current subject matter. The view in FIG. 2C is from the bottom of the lid 120 into the inside of the lid. As shown, the lid 120 may be of a generally domed shape (with a wider portion at the bottom of the lid 120 and a more narrow portion at the top), although the lid is not limited to such a shape and other shapes (such as cubes, for example) may be utilized.

The lid 120 has a lid sidewall 121 extending from a lid top 126. An inner lid region 127 is defined by the lid sidewall 121. The lid 120 has a bottom edge 124, which may be a flat edge.

As shown, one or more grooves or indentations 129 may be formed in the lid sidewall 121, which in some circumstances could allow for more easily gripping the lid 120. As shown, the indentations 129 may not extend the entire length of the lid sidewall 121, creating a lipped region along a bottom portion of the lid sidewall 121.

The lid sidewall 121 may form a third circular perimeter having a third diameter at a bottom portion of the lid sidewall 121. In an embodiment, the third diameter is equal to that of the first diameter of the first circular perimeter of the bottom portion 112 of the base sidewall 111, so that the base sidewall 111 and the lid sidewall 121 can be aligned via their respective circular perimeters (e.g., that of the bottom portion 112 of the base sidewall 111—at the flat shelf region 114—and the bottom portion 124 of the lid sidewall 121).

The lid sidewall 121 includes a lid coupling feature 125, which as shown in FIG. 2B may be one or more threaded portions 125 extending around at least a portion of an inner portion of the lid sidewall 121. The lid coupling feature 125 releasably couples to the base coupling feature 115 to thereby releasably couple the lid 120 to the base 110. In the case of threaded coupling features, the threaded portions 115, 125 may be threaded or interlocked together by twisting the lid 120 and the base 110 together. In addition, a seal between the lid 120 and the base 110 may be waterproof, such that when the lid 120 is engaged with the base 110, no water or other fluid leaks through. The seal can be made waterproof by using a rubber gasket, ensuring the connection between the lid 120 and the base 110 is tight such that no water or other fluid may pass, or using other methods to make the connection waterproof The post 118 is contained within the inner base region 117 and the inner lid region 127 when the lid 120 and the base 110 are coupled together (e.g., when the threads 115, 125 are interlocked), with the lid bottom (e.g., bottom portion 124) of the lid 120 resting on and aligned with the shelf region 114 of the base sidewall 111 of the base 110.

As shown in the bottom view of the lid 120 in FIG. 2C, an inner protrusion or downward extending edge 122 may be provided or formed on an inner top portion of the lid 120. The inner protrusion 122 may substantially be a ring formed on the inner top portion of the lid 120, sized for a top edge of the post 118 to fit within. When the base 110 and the lid 120 are coupled together, the top edge of the post 118 is surrounded by the inner protrusion 122 so that rings placed on the post 118 cannot slide off the post 118 if the storage container is turned upside down, dropped, tossed, moved, or the like.

Figure 3A:
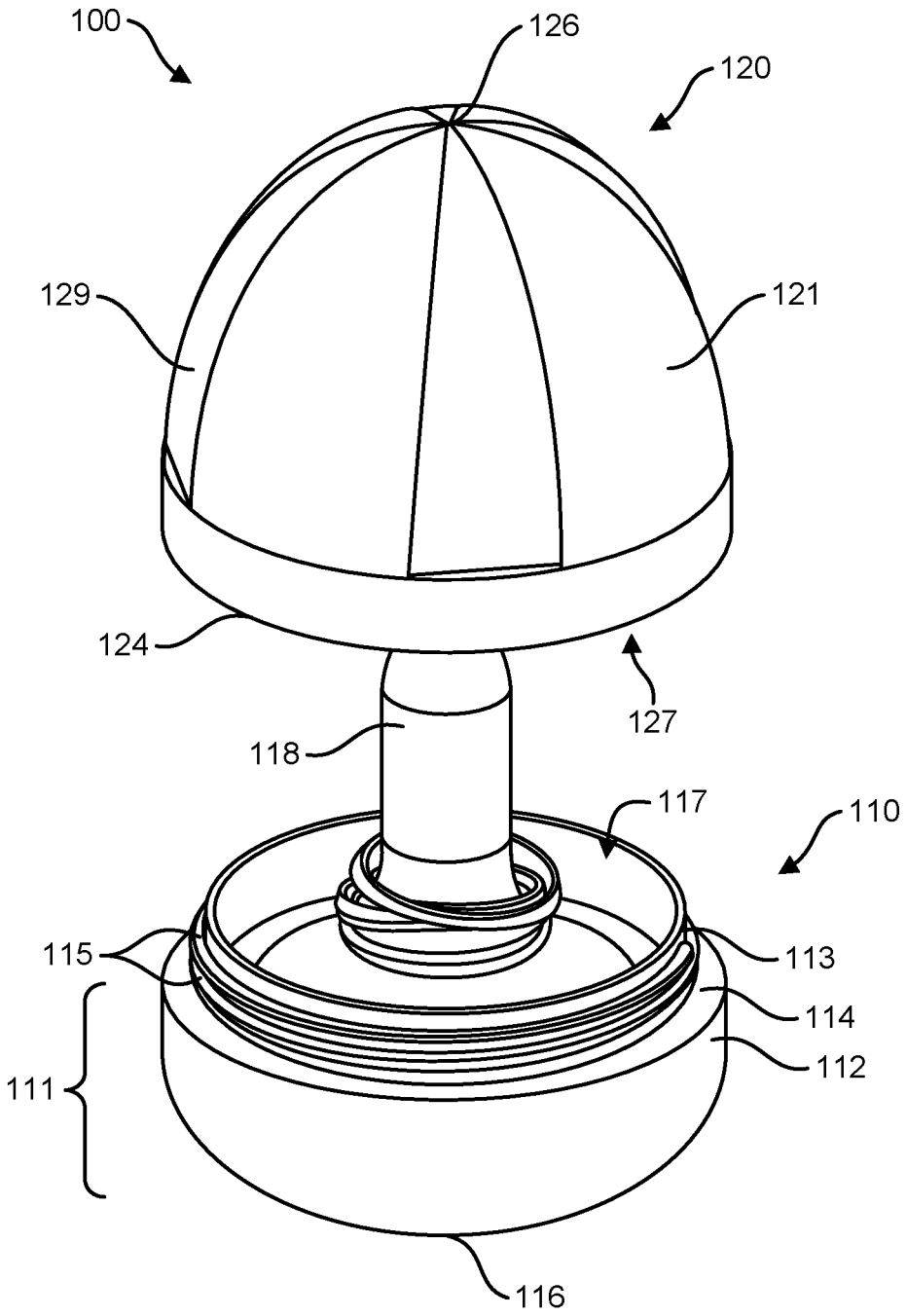
FIGS. 3A and 3B illustrate, via a top perspective view and a side cross-sectional view, respectively, features of a storage container consistent with implementations of the current subject matter.
Figure 3B:
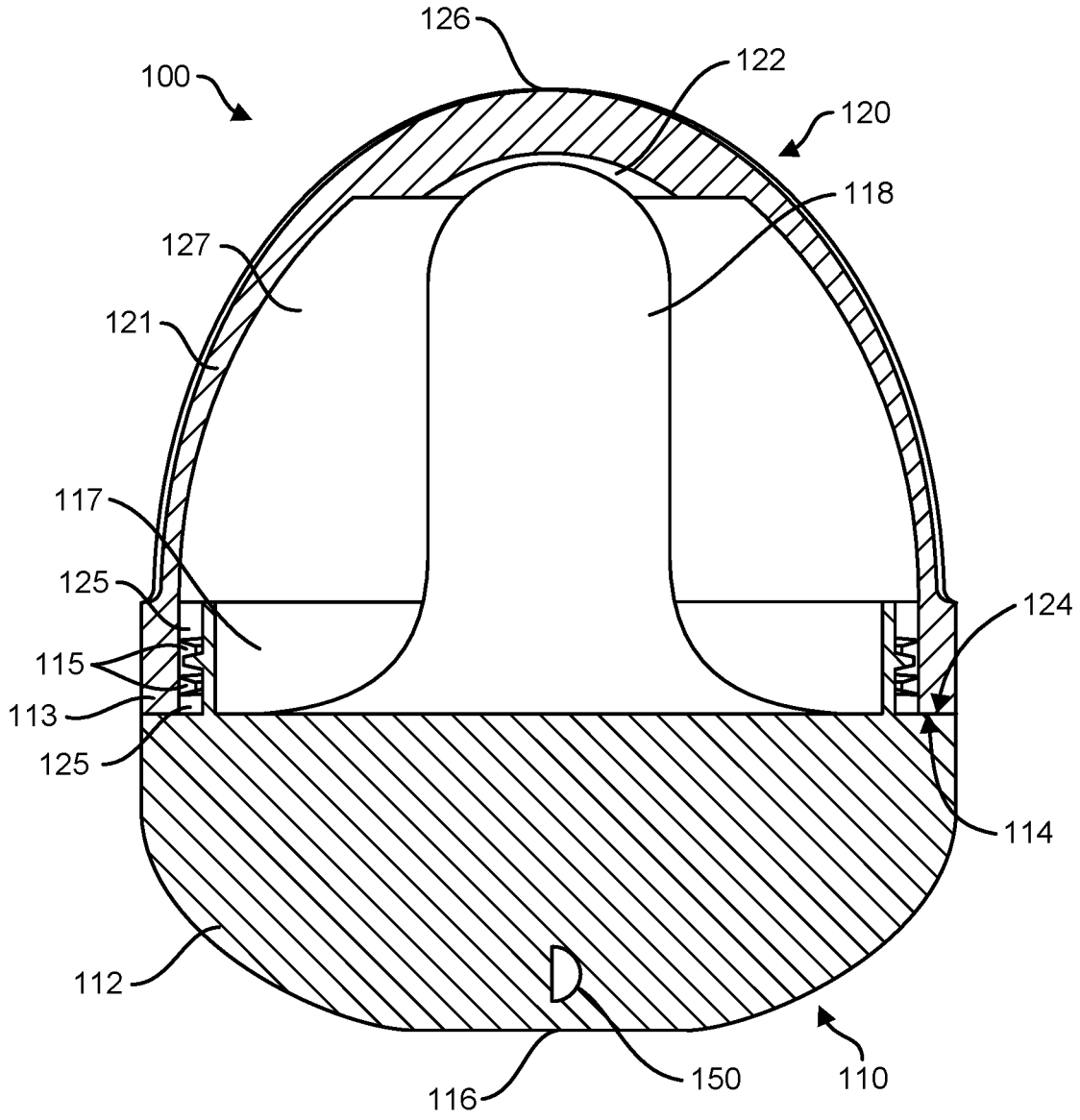

FIGS. 3A and 3B illustrate, via a top perspective view and a side cross-sectional view, respectively, features of a storage container 100 consistent with implementations of the current subject matter. As shown in FIG. 3A, rings may be placed over the post 118 and may rest within the inner base region 117. When the base 110 and the lid 120 are coupled together, the rings (and other items that may rest on the top surface of the filled region of the inner base region 117) are held safely within the inner regions 117, 127. The inner protrusion 122 (as shown in FIG. 3B) prevents the rings from sliding off the post 118. In an alternative embodiment, the post 118 may be in close proximity to or adjacent to the inner top surface of the lid 120, preventing the rings from sliding off of the post 118.

The side cross-sectional view of FIG. 3B illustrates the base 110 and the lid 120 coupled together via interlocking of the threads 115, 125.

Additionally shown in FIG. 3B, in accordance with some implementations of the current subject matter, is a cut-out portion or groove 150. This is further shown in FIG. 4, which illustrates features of an assembled storage container 100. The groove 150 is formed into the base 110 and allows for a chain 130 (or other extending cable, such as a strap, rope, or the like) to extend from the base 110. The chain 130 may be made of any suitable material, such as, for example and not limitation, rope, leather, silver (sterling or plated), gold (solid gold or plated), string, tape, magnet, chain links, copper, platinum, stainless steel, rhodium, metal alloy, synthetic leather, or other synthetic material, as well as natural fibers (wool, silk, etc.), or various combinations thereof.

A clasp 140 (or other connecting component, such as, for example and not limitation, a keychain loop, a spring ring clasp, a lobster (swivel) clasp, a barrel clasp, a toggle clasp, a magnetic clasp, a hook or "S" clasp, a fishhook clasp, a side lock clasp, an adjustable clasp, a ball and joint clasp, a bead clasp, a box (or tab) insert clasp, a button toggle clasp, a crimping clasp, a filigree clasp, a screw clasp, a slide lock clasp, a tab lock clasp, or a twister clasp) is secured or attached to an end of the chain 130. This allows for the storage container 100 to be securely and removably attached to a belt loop, key ring, purse, gym bag, or other personal storage item.

Figure 4:
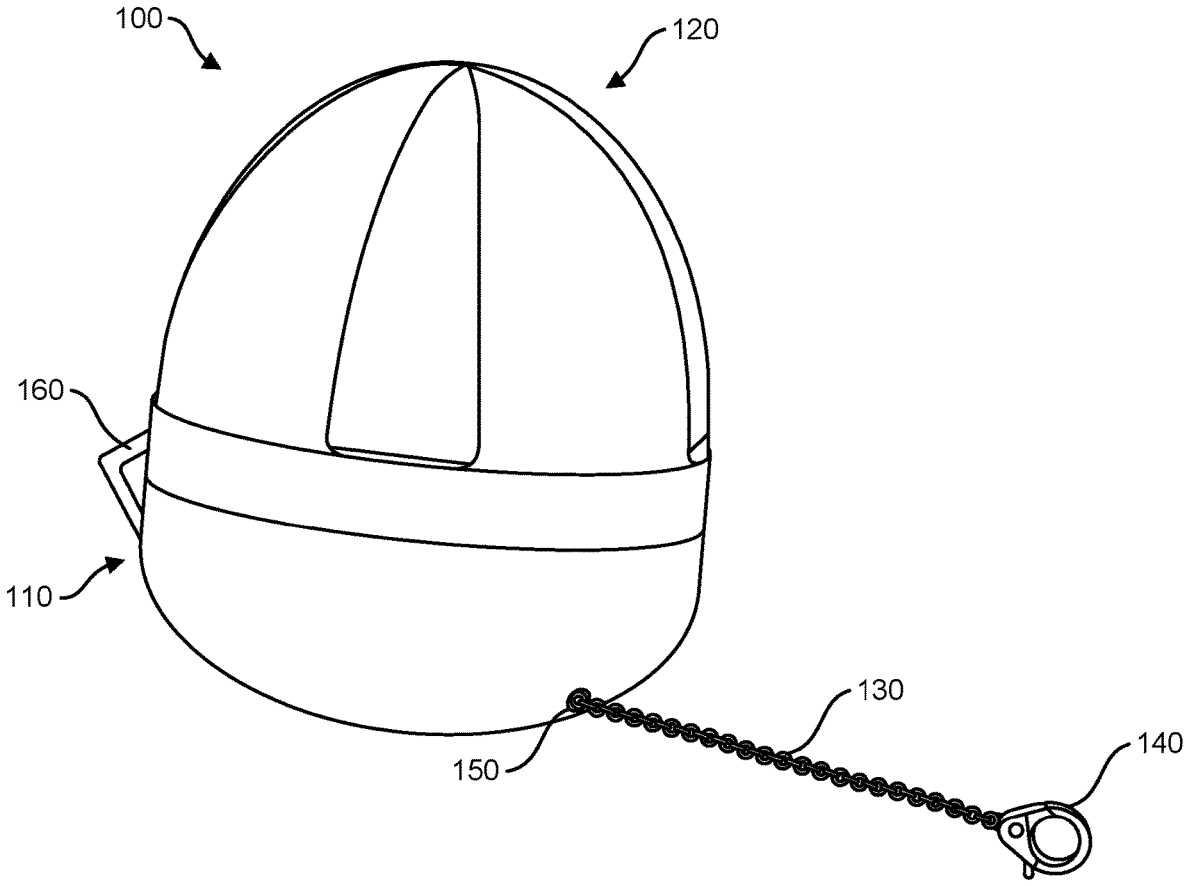
FIG. 4 illustrates additional features of a storage container consistent with implementations of the current subject matter.

Also shown in FIG. 4 is a linking component 160, with a first end attached to the base 110 and a second end attached to the lid 120. The linking component 160 may be a flexible and/or bendable material that allows for the base 110 and the lid 120 to stay together (e.g., in one place) even when not directly coupled together via coupling features (e.g., threads) 115, 125.

Figure 5:
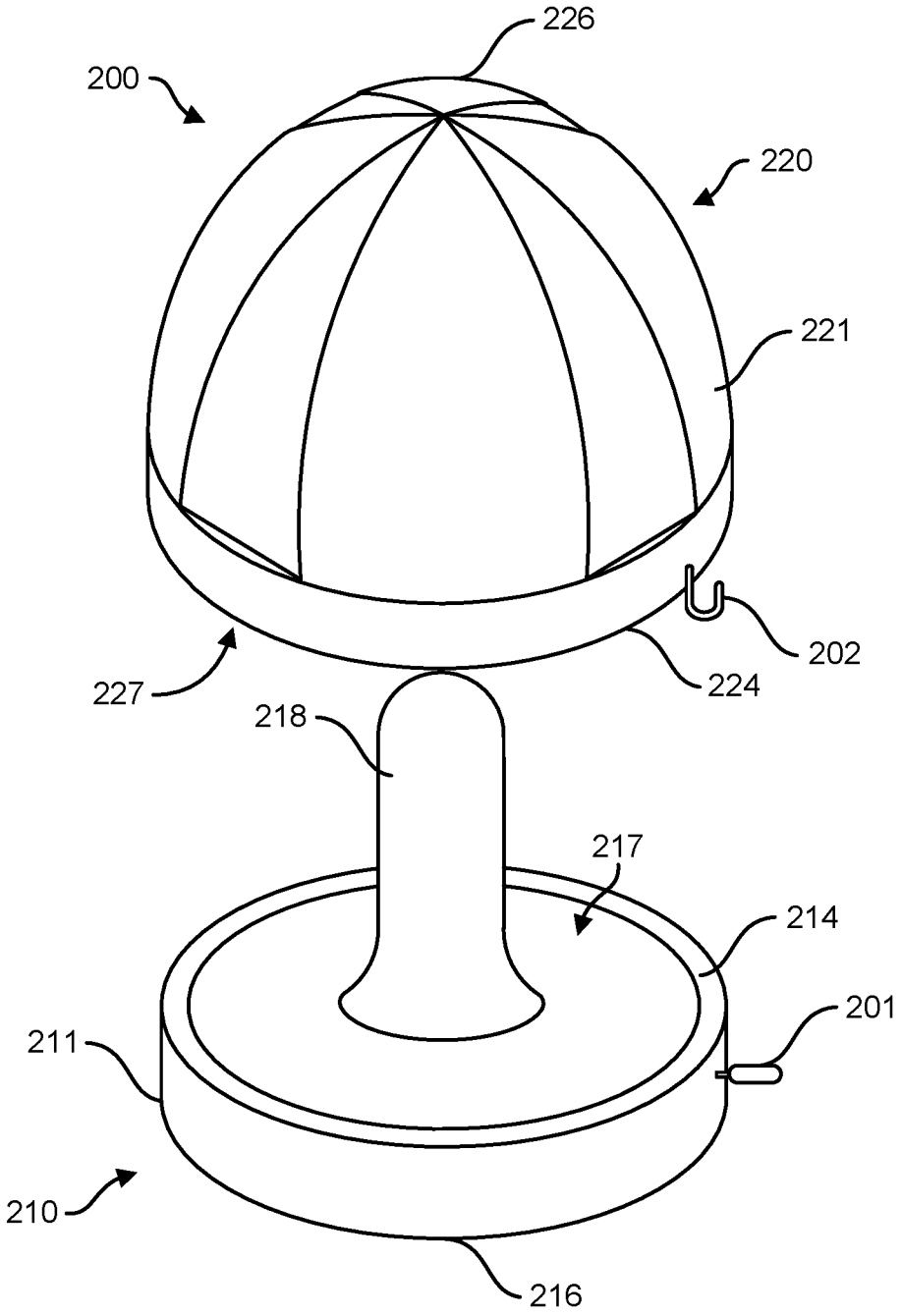
FIG. 5 illustrates features of a storage container consistent with additional implementations of the current subject matter.

FIG. 5 illustrates features of a storage container 200 consistent with additional implementations of the current subject matter. The storage container 200 includes a base 210 with base sidewall 211 extending upward from a base bottom plate 216. The base sidewall 211 define an inner base region 217. A post 218 extends vertically upwardly from a bottom portion of the base 210. The base sidewall 211 forms a first circular perimeter having a first diameter at a top edge of the base sidewall (a shelf region 214).

A lid 220 of the storage container 200 has a lid sidewall 221 extending from a lid top 226. An inner lid region 227 is defined by the lid sidewall 221. The lid 220 has a bottom edge 224, which may be a flat edge. The lid sidewall 221 forms a third circular perimeter having a third diameter equal to that of the first diameter of the base sidewall 211.

The post 218 is contained within the inner base region 217 and the inner lid region 227 when the lid 220 and the base 210 are coupled together, with the lid bottom (e.g., bottom portion 224) of the lid 220 resting on and aligned with the shelf region 214 of the base sidewall 211.

The base 210 and the lid 220 have one or more coupling features that allow for the base 210 and the lid 220 to be coupled together. For example, as shown in FIG. 5, a hook 202 (the lid coupling feature) may couple with an eye 201 (the base coupling feature). While a hook 202 and eye 201 are shown, the storage container consistent with implementations of the current subject matter is not limited to such a fastener. For example, an appropriately sized lock and key may be incorporated. As an additional example, the shelf region 214 and the bottom edge 224 of the lid may form a magnetic attachment to secure the lid 220 and the base 210. Other suitable fastening components, in any combination, could also be used, such as Velcro, snaps, a zipper, metal clasp, button, or the like.

Figure 6:
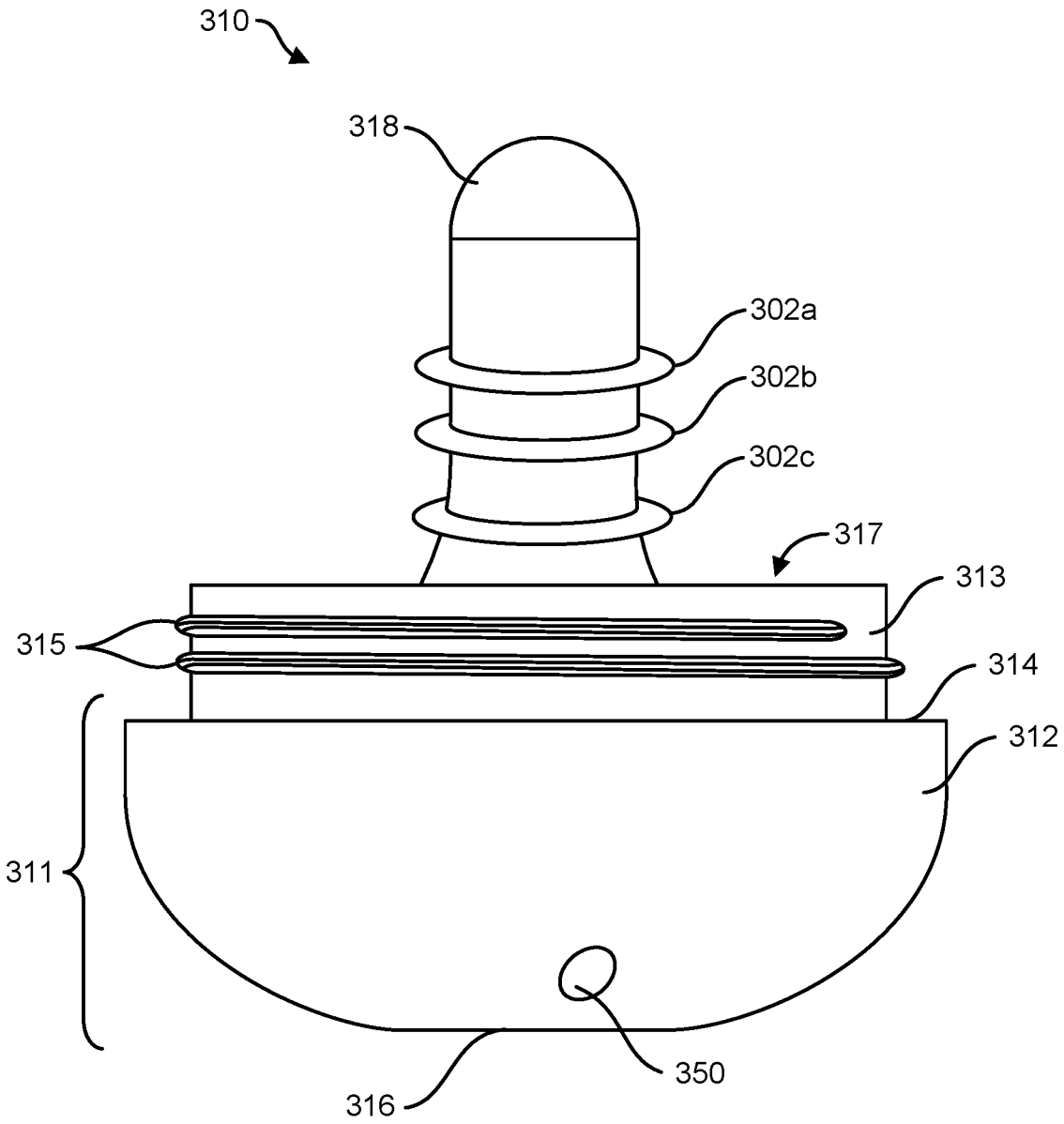
FIG. 6 illustrates features of a base of a storage container consistent with additional implementations of the current subject matter.

FIG. 6 illustrates features of a base 310 of a storage container consistent with additional implementations of the current subject matter. The base 310 is similar to the base 110 described above, with base sidewall 311 with sidewall portions 312 and 313 with flat shelf region 314 extending therebetween. The base sidewall 311 extends from a base plate or bottom 316 and defines an inner base region 317. A base coupling feature 315 is provided for coupling with a lid. A groove 350 is provided from which a chain or other extending cable may extend to secure (with a clasp or other connecting component). A post 318 extends vertically upward from a bottom portion of the base 310.

One or more separators 302*a,b,c* (three are shown but fewer or more may be provided, such as one, two, four, five, or the like) are provided at various positons along the length of the post 318 to separate a plurality of rings from one another for extra protection of the rings. The separators 302*a,b,c* may be formed of a flexible yet resilient material (e.g., foam or a soft rubber) that deforms to allow for a ring to slide over but that provides sufficient support to hold a ring thereon. The separators 302*a,b,c* may be fixed to the post 318 or may be removable and/or adjustable.

Figure 7:
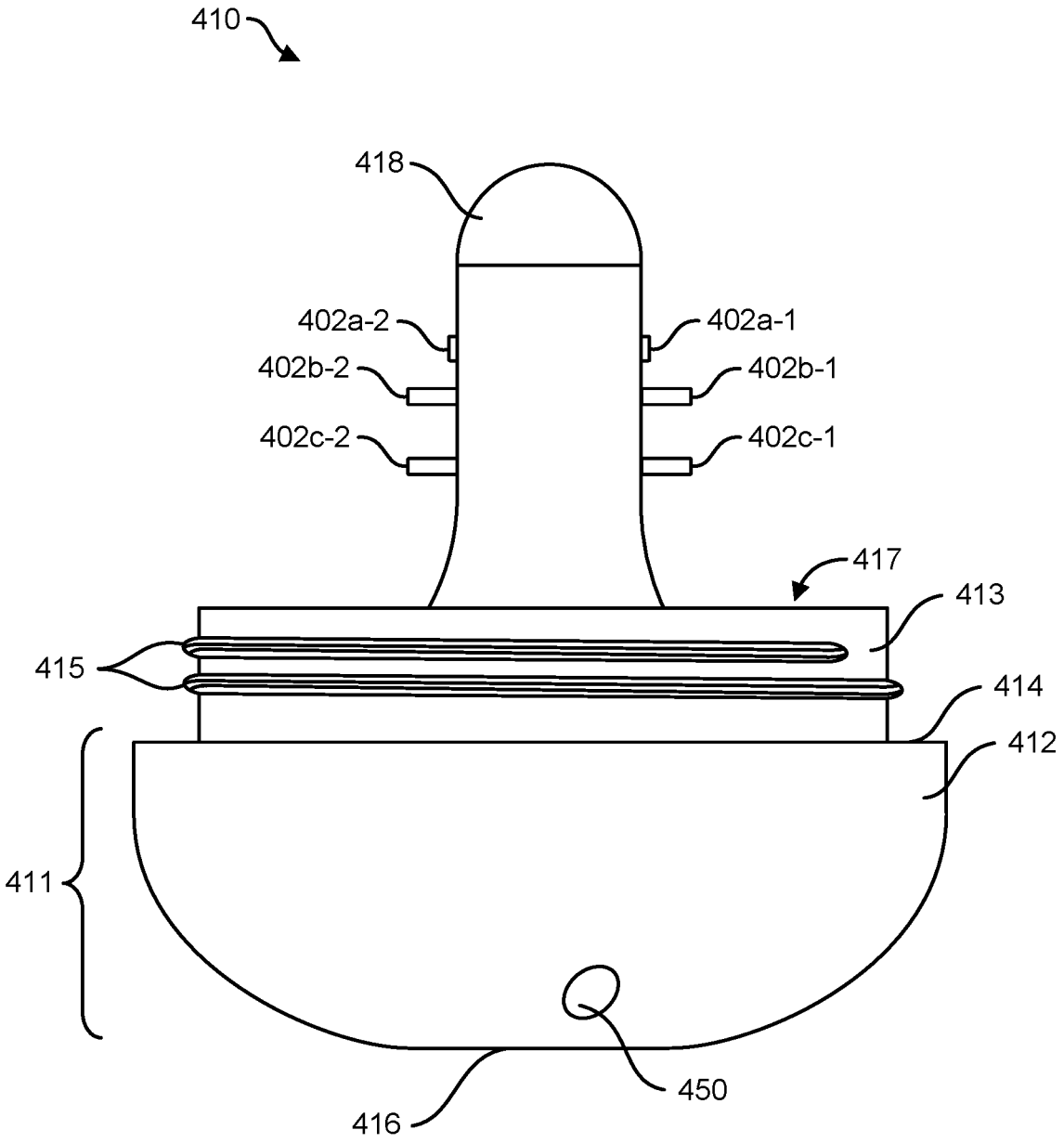
FIG. 7 illustrates features of a base of a storage container consistent with yet additional implementations of the current subject matter.

FIG. 7 illustrates features of a base 410 of a storage container consistent with yet additional implementations of the current subject matter. The base 410 is similar to the base 110 described above, with base sidewall 411 with sidewall portions 412 and 413 with flat shelf region 414 extending therebetween. The base sidewall 411 extends from a base plate or bottom 416 and defines an inner base region 417. A base coupling feature 415 is provided for coupling with a lid. A groove 450 is provided from which a chain or other extending cable may extend to secure (with a clasp or other connecting component). A post 418 extends vertically upward from a bottom portion of the base 410.

One or more pairs of protruding separators 402*a*-1,2, 402*b*-1,2, 402*c*-1,2, as shown in FIG. 7, may be provided at various positions along the length of the post 418 to separate one or more rings from one another. While three pairs of protruding separators are shown, fewer or more may be provided, such as one, two, four, five, or the like. Moreover, instead of pairs of protruding separators, a single separator or a separator with a plurality of components may be utilized. The pairs of protruding separators may fit within a portion of the post 418 and may extend perpendicularly outward from the post 418 upon depression of the appropriate separators. A subsequent depression of the appropriate separators may then cause the separators to again be fitted within the post 418. For example, as shown as an example in FIG. 7, a first pair of protruding separators 402*a*-1,2 are shown mostly contained or fitted within the post 418, while two other pairs (402*b*-1,2 and 402*c*-1,2) are shown extended outward to hold one or more rings on the protruding portions.

Figure 8A:
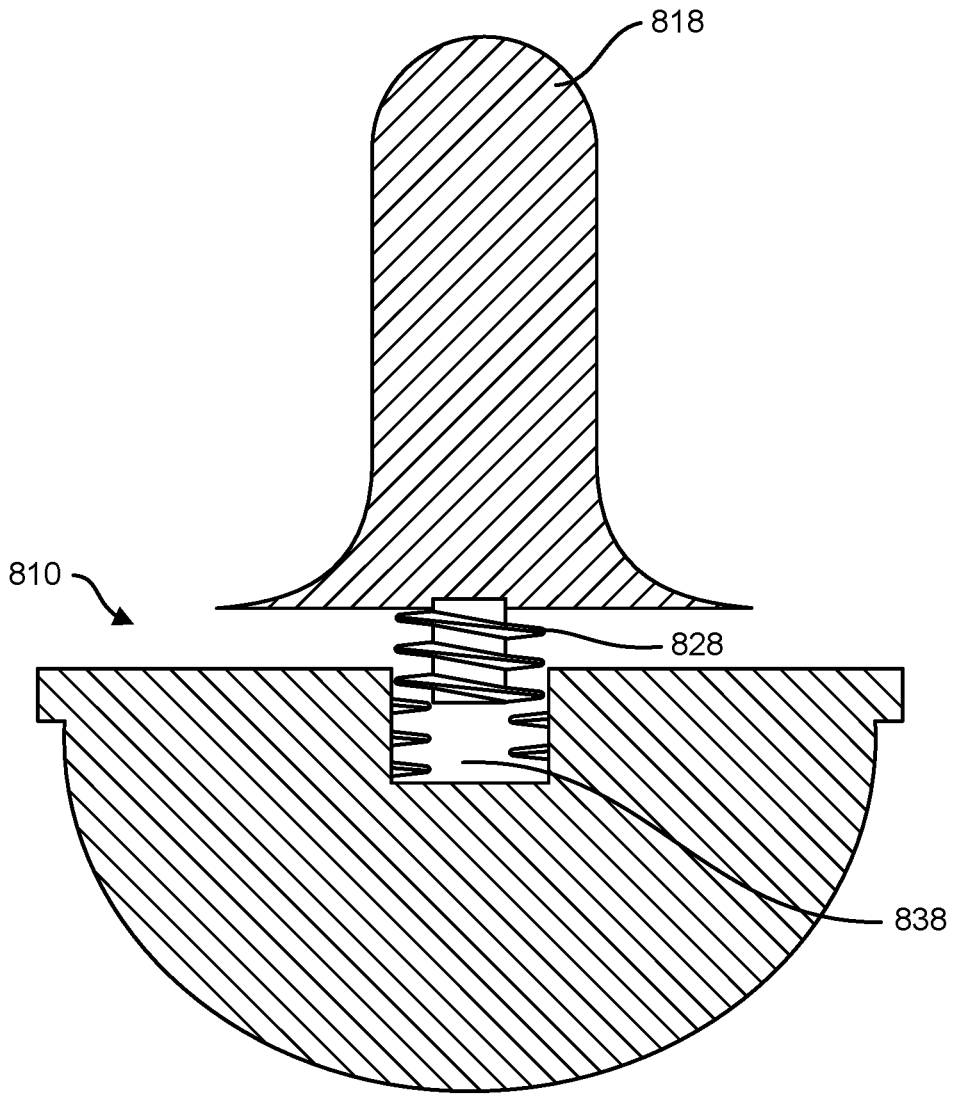
FIGS. 8A and 8B illustrate features of a base of a storage container consistent with yet additional implementations of the current subject matter.
Figure 8B:
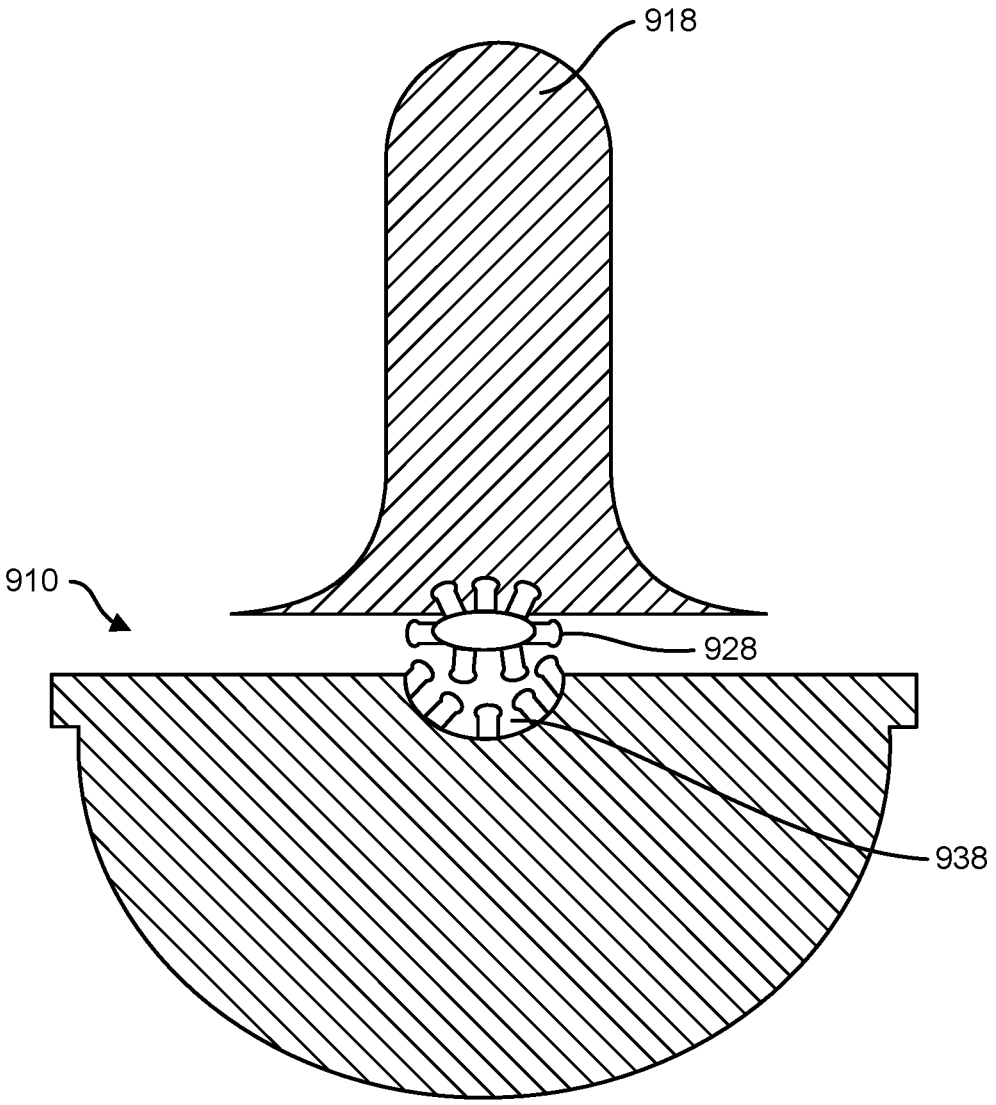

FIGS. 8A and 8B illustrates features, via side cross-sectional views, of bases 810 and 910 with respective removable posts 818 and 918, consistent with additional implementations of the current subject matter. In accordance with implementations of the current subject matter, one or more posts may be removable so that posts of varying diameters, to accommodate rings of different sizes, can be attached to the base. Such a removable connection may include, for example with reference to FIG. 8A, a screw-like component 828 at a bottom edge of the post 818 to screw into and out of a threaded recess 838 formed within a bottom portion of the base 810. In another embodiment, an opposite configuration with a screw-like component extending outward from a bottom portion of the base to receive various posts, one at a time may be implemented. FIG. 8B illustrates another implementation for a removable post 918 in which a circular cut-out attachment 928 with multiple tabs is positioned on the bottom of the post 918. The attachment 928 fits into a corresponding circular cut-out recess 938, also with multiple tabs. The post 918 snaps into the base 910 after a snap and turn placement, the tabs of the post 918 interlocking with the tabs of the base 910. Other suitable removable connections could be implemented.

The base and the lid of the ring storage container consistent with implementations of the current subject matter may be made from various structurally sound materials, such as, for example and not limitation, plastic, hard rubber, or other synthetic materials. A waterproof covering may be provided over the outer surfaces of the base and the lid. Other coverings may instead be provided, such as a leather skin, a linen covering, a nylon covering, etc. The coverings, or the base and the lid themselves, may be colored or textured as desired.

In accordance with implementations of the current subject matter, the ring storage container may include a cleaning solution storage and applicator, for emitting a cleaning solution when the base and the lid are coupled together. Such a storage and applicator may be contained within the base or top portion, and an external button or the like may cause the cleaning solution to be emitted.

A ring storage container consistent with implementations of the current subject matter may include a Bluetooth chip or the like so that a location of the ring storage container can be determined.

Various aspects of the different embodiments described herein may be combined. For example, the hook 202 and the eye 201 shown in FIG. 5 (or other locking mechanisms such as a latch, screw, clasp, magnets, or the like) could be combined with the threaded coupling features shown in FIGS. 1A-3B.

A ring storage container in accordance with implementations of the current subject matter, provides a personal ring holder for use when it may be desirable (e.g., at a nail salon, at the gym, at an airport, when washing hands or changing a diaper, etc.) for one or more individuals to remove and store their rings or other small personal items. A ring storage container consistent with implementations described herein may include a variety of sizes (e.g., small, medium, large) to hold fewer rings (small size) or more rings (large size), with each of the components sized accordingly. Additionally, the thickness of the sides (e.g., the sidewalls) may vary, with some of the ring storage containers having thicker walls than others. The thickness of the walls may depend on, for example, the material being used and/or the type of coupling features. Moreover, when used, the ring storage container can be shockproof such that if the ring storage container is dropped, the stored ring(s) or other small personal items are not damaged.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A storage container comprising:

a base comprising an inner base region defined by a base sidewall extending from a base plate, the base sidewall including a base coupling feature, the base further comprising a post extending vertically upward from the inner base region for holding one or more rings thereon; and a lid comprising an inner lid region defined by a lid sidewall extending from a lid top, the lid sidewall including a lid coupling feature that releasably couples to the base coupling feature to thereby releasably couple the lid to the base;

wherein the post is contained within the inner base region and the inner lid region when the lid and the base are coupled together; and wherein one or more separator components are each formed around a circumference of the post, the one or more separator components configured to hold one or more of the one or more rings at a respective position along the post.

2. The storage container of claim 1, wherein the base coupling feature includes a threaded portion that interlocks with an opposing threaded portion of the lid coupling feature.

3. The storage container of claim 1, wherein the base sidewall forms a first circular perimeter having a first diameter and a second circular perimeter having a second diameter less than that of the first diameter, and wherein the first circular perimeter and the second circular perimeter are joined by a shelf region.

4. The storage container of claim 3, wherein the base coupling feature is positioned on the second circular perimeter.

5. The storage container of claim 3, wherein a lid bottom of the lid rests on the shelf region of the base sidewall when the lid and the base are coupled together.

6. The storage container of claim 5, wherein the lid sidewall forms a third circular perimeter having a third diameter equal to that of the first diameter.

7. The storage container of claim 6, wherein the first circular perimeter and the third circular perimeter are aligned when the lid and the base are coupled together.

8. The storage container of claim 6, wherein the base sidewall forms the first circular perimeter having a first diameter and the lid sidewall forms the third circular perimeter having a third diameter equal to that of the first diameter.

9. The storage container of claim 8, wherein, when the lid and the base are coupled together, the first circular perimeter and the third circular perimeter are aligned.

10. The storage container of claim 1, wherein an opening is formed in a portion of the base sidewall from which a chain with a connecting component extends.

11. The storage container of claim 1, wherein an inner protrusion is formed on an inner top portion of the lid, the inner protrusion sized for a top edge of the post to fit within.

12. The storage container of claim 1, wherein a plurality of indentations are formed around a circumference of the lid in the lid sidewall.

13. The storage container of claim 1, further comprising a flexible linking component, wherein a first end of the flexible linking component is attached to the base sidewall and a second end of the flexible linking component is attached to the lid sidewall, the flexible linking component configured to hold together the base and the lid.

14. The storage container of claim 1, wherein the base sidewall further includes a second base coupling feature and the lid sidewall further includes a second lid coupling feature that releasably couples to the second base coupling feature.

15. The storage container of claim 1, wherein the post is removable from the inner base region of the base.

* * * * *